US005571986A

United States Patent [19]

Snider et al.

[11] Patent Number: 5,571,986

[45] Date of Patent: Nov. 5, 1996

[54] METHOD AND APPARATUS FOR ACTIVATING AN ELECTRIC WIRELINE FIRING SYSTEM

[75] Inventors: Philip M. Snider, Houston; David S. Wesson, Waxahachie; Lyle W. Andrich, Mansfield; William D. Smith, Fort Worth, all of Tex.

[73] Assignee: Marathon Oil Company, Findlay, Ohio

[21] Appl. No.: 504,544

[22] Filed: Jul. 20, 1995

Related U.S. Application Data

[63] Continuation of Ser. No. 286,155, Aug. 4, 1994, abandoned.

[51] Int. Cl.[6] ..... C06C 5/00; E21B 7/00; E21B 29/02

[52] U.S. Cl. ..... 102/275.11; 89/1.15; 166/297; 175/4.56

[58] Field of Search ..... 89/1.15; 175/4.56, 175/4.54, 4.55; 166/297; 102/275.6, 275.11, 255, 257, 228, 232, 238, 248, 264

[56] References Cited

U.S. PATENT DOCUMENTS

| | | | |
|---|---|---|---|
| 2,426,517 | 8/1947 | McWhorter | 164/.5 |
| 2,540,184 | 2/1951 | Broyles | 164/.5 |
| 2,630,067 | 3/1953 | McWhorter | 102/38 |
| 3,517,757 | 6/1970 | Hart | 175/4.55 |
| 3,612,189 | 10/1971 | Brooks et al. | 175/4.54 |
| 3,730,282 | 5/1973 | Chapman | 175/4.51 |
| 3,860,865 | 1/1975 | Stroud et al. | 89/1.15 |
| 4,164,886 | 8/1979 | Hallmark | 89/1.15 |
| 4,220,212 | 9/1980 | Lands, Jr. | 89/1.15 |
| 4,484,639 | 11/1984 | Ayers | 175/4.56 |
| 4,491,185 | 1/1985 | McClure | 175/4.56 |
| 4,614,156 | 9/1986 | Colle, Jr. et al. | 102/275.11 |
| 4,616,718 | 10/1986 | Gambertoglio | 175/4.54 |
| 4,886,126 | 12/1989 | Yates, Jr. | 175/4.54 |
| 4,901,802 | 2/1990 | George et al. | 102/275.11 |
| 4,911,251 | 3/1990 | George et al. | 102/275.11 |
| 5,007,344 | 4/1991 | Ricles | 102/31.2 |
| 5,191,936 | 3/1993 | Edwards et al. | 166/297 |
| 5,301,755 | 4/1994 | George et al. | 166/297 |
| 5,369,579 | 11/1994 | Anderson | 175/4.54 |

FOREIGN PATENT DOCUMENTS

| | | | |
|---|---|---|---|
| 1048925 | 2/1979 | Canada | 166/13 |

*Primary Examiner*—Michael J. Carone
*Assistant Examiner*—Theresa M. Wesson
*Attorney, Agent, or Firm*—Jack L. Hummel; Jack E. Ebel

[57] ABSTRACT

A method and apparatus of activating electric wireline firing systems in which a firing pin is restrained against movement toward a detonator until application of sufficient voltage to the apparatus. The firing pin is not permitted to move immediately upon application of voltage to the apparatus thereby providing a period during which voltage may be interrupted to prevent detonation of the system. The requisite voltage which must be applied to the apparatus is relatively high thereby ensuring against premature detonation of the system due to high radio frequencies, stray voltages or other electrical influences.

32 Claims, 5 Drawing Sheets

METHOD AND APPARATUS FOR ACTIVATING AN ELECTRIC WIRELINE FIRING SYSTEM

This application is a file wrapper continuation-in-part of U.S. patent application Ser. No. 08/286,155, filed on Aug. 8, 1994, now abandoned.

BACKGROUND OF THE INVENTION

1. Field of the Invention

The present invention relates to apparatus and methods for activating electric wireline firing systems in which a firing pin is actuated by pressure, and more particularly, to such apparatus and methods in which the firing pin is not actuated simultaneously with application of electrical voltage to the apparatus.

2. Description of Related Art

Many devices conventionally utilized to complete or work over a subterranean well, such as perforating guns, jet cutters, and chemical cutters, are actuated by applying electrical current of a specified voltage to an electric detonator via a wireline on which the device is suspended from a surface wellhead. Application of the specified electrical voltage via wireline to these devices detonates an electrical blasting cap or detonator which is connected to and in turn detonates the explosive charge of a perforating gun, a jet cutter, a chemical cutter, or a similar system. The electrical current required to detonate the blasting cap or detonator of these devices is relatively low, for example 0.2 amps for a duration of one second or less.

A significant problem associated with detonating such conventional devices via an electric wireline is that the presence of high radio frequencies, stray voltages, or other electrical influences, such as welding or cathodic protection, in the vicinity of the surface location of the wellhead may inadvertently result, via an electrical short in the wireline spool or if the device is not properly grounded, in the premature detonation of the device at the surface or prior to proper placement of the device at a desired location within a subterranean well. Premature detonation can also result from human error of inadvertent supplying sufficient electrical voltage to detonate the firing apparatus. Such premature detonation results in an extremely unsafe operating environment which can result in injuries and even fatalities at or near the wellhead. It is believed that the majority of accidents involving the use of explosives in a subterranean well are a result of such premature detonations.

In an effort to improve the safety of detonation operations using an electric wireline, operators have attempted to eliminate radio frequencies and stray voltages near the wellhead. However, such operations can take a considerable amount of time and be expensive and have not been completely effective, especially in more populous areas where complete elimination of radio frequencies, stray voltages and other electrical influences generated by third parties is often not practical. Thus, a need exists for an electric wireline firing system which can be safely used in conjunction with a conventional downhole explosive device.

Accordingly, it is an object of the present invention to provide a method and apparatus for safely activating electric wireline firing systems.

It is another object of the present invention to provide a method and apparatus in which the firing pin of an electric wireline firing system is not actuated simultaneously with application of electrical voltage to the apparatus.

It is a further object of the present invention to provide a method and apparatus for safely activating the firing pin of an electric wireline firing system which is inexpensive to construct and to operate.

it is a still further object of the present invention to provide a method and apparatus for safely activating the firing pin of an electric wireline firing system which requires that a relatively high voltage be applied to detonate the firing apparatus.

SUMMARY OF THE INVENTION

To achieve the foregoing and other objects, and in accordance with the purposes of the present invention, as embodied and broadly described herein, one characterization of the present invention is a an apparatus for activating electric wireline firing systems is provided which comprises a means for securing a firing pin against movement toward a detonator and a means for releasing the firing pin from the securing means in response to voltage being applied to the releasing means.

In another embodiment of the present invention an apparatus is provided for activating electric wireline firing systems. The apparatus comprises a tubular housing and a motor having a lead screw secured thereto and positioned within the housing. A bushing is positioned upon the lead screw and is capable of axial movement upon the lead screw when the latter is rotated. An elongated rod is positioned within the housing and connected to the bushing. A firing pin is positioned within said housing and secured against movement by the elongated rod.

In yet another embodiment of the present invention, a method is provided for activating an electric wireline firing system which has a firing pin and a detonator. The method comprises releasably securing a firing pin against movement toward a detonator by securing means connected to a motor and applying a voltage to the motor which is sufficient to move the securing means and permit the firing pin to move and strike the detonator.

BRIEF DESCRIPTION OF THE DRAWINGS

The accompanying drawing, which is incorporated in and forms a part of the specification, illustrates the embodiments of the present invention and, together with the description, serves to explain the principles of the invention.

In the drawings.

DETAILED DESCRIPTION OF THE PREFERRED EMBODIMENTS

Figure 1A:
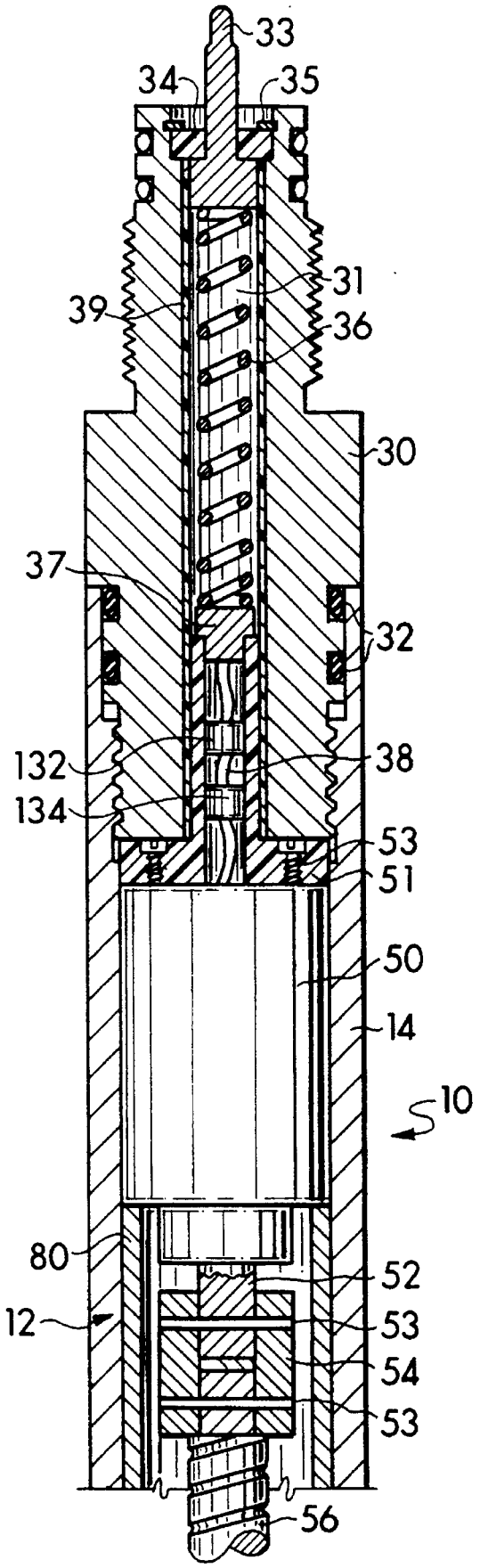
FIGS. 1*a*, 1*b* and 1*c* are a partially cutaway, cross sectional view of one embodiment of the detonating apparatus of the present invention.

Referring to FIG. 1, the apparatus of the present invention is illustrated generally as 10 and comprises a generally tubular housing 12 having a first section 14 and a second section 16 which are releasably secured together by means of threaded engagement with connection sub 20. Connection sub 20 has a bore 22 therethrough. Second section 16 is provided with at least one port 17 therethrough which may be sealed with any suitable means 19 (FIG. 2), such as wax, gel or metal, which is removed upon being subjected to downhole temperature, pressure, and/or fluid encountered in a well. A plurality of O-rings 24 are positioned between the connection sub 20 and first and second housing sections 14 and 16, respectively, to provide a fluid tight seal therebetween. One end of housing 12 is releasably secured to an electrical connection sub 30 by threaded engagement while the other end of housing 12 is releasably secured to a detonator connection sub 40 by threaded engagement therewith. O-rings 32 are positioned between first housing section 14 and electrical connection sub 30 and O-rings 42 are positioned between second housing section 16 and detonator connection sub 40 to provide for a fluid tight seal therebetween.

Electrical connection sub 30 is provided with a bore 31 therethrough. An insulating sleeve 39 is positioned within bore 31 to electrically insulate component parts which are positioned therein. A contact pin 33 is positioned within bore 31 and sleeve 39 and extends through insulating bushing 34 which is secured within sub 30 by any suitable means, for example snap ring 35. A spring 36 is also positioned within bore 31 and sleeve 39 and contacts pin 33 at one end thereof and contact button 37 at the other end thereof. Contact button 37 mates within one end of insulator cap 51 which is partially positioned within sleeve 39 and which is secured to motor 50 by any suitable means, for example bolts 53. Insulating sleeve 39, insulating bushing 34 and insulator cap 51 are constructed of suitable electrical insulating material, for example phenolic resin.

Electrical connection sub 30 is electrically connected to a D.C. electrical motor 50 by means of wire 38 which is secured to contact button 37. Motor 50 has a shaft 52 extending from one end thereof. A coupling 54 is secured at opposite end thereof to shaft 52 and lead screw 56 by means of pins 53. A bushing or rolled thread nut assembly 60 is positioned around lead screw 56 and has a plurality of ball bearings (not illustrated) positioned within races formed between the interior of bushing 60 and the exterior of lead screw 56. At least one ball feed tube 64 is integrally formed with bushing 60 and protrudes from the external surface thereof. Ball feed tubes 64 function to align bearings within the races. Straps 65 are provided on the exterior of bushing 60 to retain the ball bearings within such tubes and races. As assembled upon lead screw 56, bushing 60 can be moved in either direction along the axis of lead screw 56 depending upon the rotation applied to screw 56 by motor 50.

A guide sleeve 80 is positioned within first section 14 of tubular housing 12 between motor 50 and connection sub 20. Guide sleeve 80 is secured to connection sub 20 by means of set screw 81 and is provided with a slot 82. A guide pin 77 is threadably engaged to and extends from the outer surface of guide coupling 70 so as to be received within slot 82 of guide sleeve 80 and inhibit rotation of guide coupling 70 and therefor bushing 60 and retainer rod 90 during operation of the present invention. A shear pin 83 may be provided in guide coupling 70 and extends into guide sleeve 80 to inhibit movement of bushing 60 along lead screw 56 until a predetermined amount of torque is applied by motor 50. Such shear pin affords the operator of the apparatus a small period of time after application of voltage to motor 50 within which voltage may be terminated prior to movement of any apparatus components which would cause detonation.

Figure 1B:
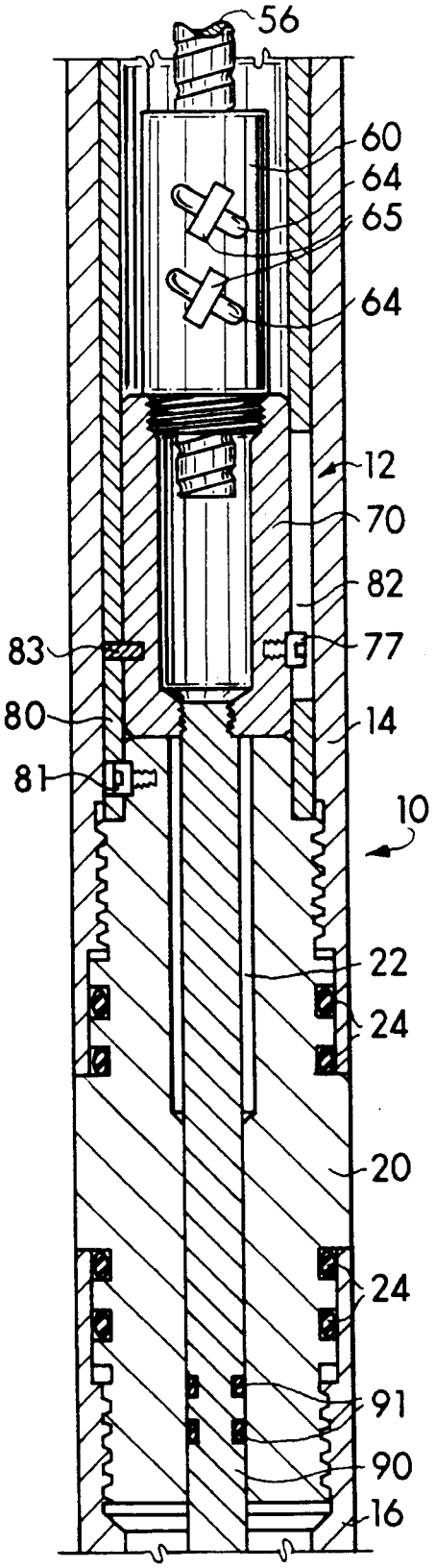

Guide coupling 70 is releasably secured by threaded engagement to one end of bushing 60 and to one end of a retainer rod 90 by means of separate sets of screw threads as illustrated in FIGS. 1*a* and 1*b*. Retainer rod 90 extends through bore 22 in connection sub 20 and terminates in a retainer sleeve portion 94 of a substantially greater diameter and having at least one port 95 therethrough. O-rings 91 are provided around rod 90 to provided a fluid tight seal between rod 90 and connection sub 20. Retainer sleeve portion 94 of rod 90 is positioned within second portion 16 of tubular housing 12 and receives an elongated male portion 44 of detonator connection sub 40. Male portion 44 has at least one port 45 in the sidewall thereof. A firing pin 100 has a groove formed within the outer surface thereof and is positioned within bore 41 through sub 40. Firing pin 100 is releasably secured within male portion 44 by means of at least one ball 46 which is positioned within at least one port 45 and is biased into engagement with firing pin 100 by retainer sleeve portion 94. O-rings 101 are positioned around firing pin 100 to provide for a fluid tight seal with detonator connecting sub 40 as thus assembled.

Figure 1C:
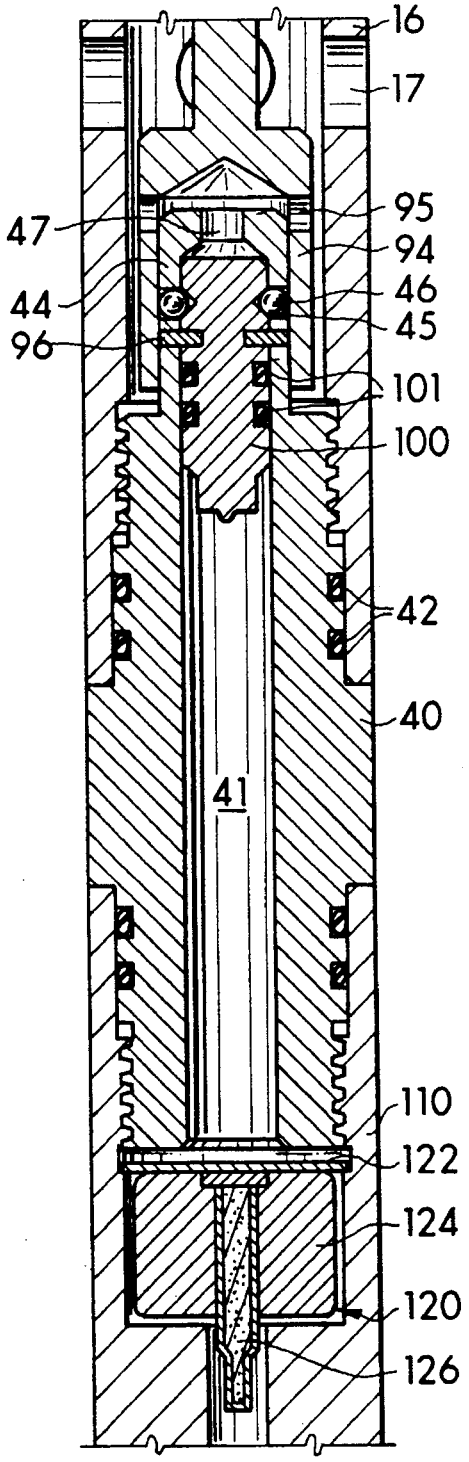

One end of detonator connecting sub 40 is releasably secured to a detonator sub 110 by threaded engagement. A detonator which is illustrated in FIG. 1*c* generally as 120 comprises a relatively thin disk 122 constructed of a suitable material, such as copper, a housing 124, and an explosive charge 126. The other end of detonator sub 110 can be provided with a suitable male, female or other coupling to secure the assembly of the present invention to a desired tool, for example perforating gun(s), jet cutter(s), or chemical cutter(s).

As assembled, the contact pin 33 of the firing assembly of the present invention is secured to a casing collar locator which in turn is suspended from the wellhead at the surface by wireline (not illustrated) as will be evident to a skilled artisan. The assembly is lowered into the subterranean well until the tool which is secured thereto is positioned at a desired depth. Once positioned within a well, fluid within the well will be communicated into the interior of second portion 16 of housing 12 via port(s) 17 and the interior of sleeve portion 94 of retainer rod 90 via ports 95. Any means initially blocking port(s) 17 will have been first removed by means of well temperature and/or pressure and/or contact with well fluid. O-rings 24, 42, 91 and 101 cooperate to maintain well fluid within this area of the apparatus. Although fluid pressure is transmitted to motor 50 via retainer rod 90, guide coupling 70, bushing 60 and lead screw 56, the gear ratio of the motor provides sufficient mechanical resistance to prevent lead screw from rotating. Initially firing pin 100 is secured within male portion 44 of connecting sub 40 by means of at least one ball 46 which is positioned within at least one port 45 and is biased into engagement with firing pin 100 by retainer sleeve portion 94. Once a desired subsurface location is reached, electrical current is applied to motor 50 from an electrical source at the surface, such as a power supply, via the wireline, casing collar locator, and electrical connection sub 30. Motor 50 rotates shaft 52 and lead screw 56 causing bushing 60 and in turn guide coupling 70 and retainer rod 90 to move axially upwardly until retainer sleeve portion 94 moves past ball(s) 46. Once sleeve portion 94 no longer biases ball(s) 46 inwardly, the pressure of well fluid on firing pin 100 forces ball(s) 46 outwardly thereby disengaging and permitting downward movement of firing pin 100. Fluid pressure communicated via port(s) 17 and 45 forces firing pin 100 downwardly through subs 40 and 110 and into contact with detonator 120 thereby striking plate 122 and detonating explosive charge 126. Detonation of charge 126 in turn detonates an explosive detonating cord (not illustrated) which activates the tool secured to the assembly.

By utilizing the assembly of the present invention, a significant time delay occurs between when electrical voltage is applied to the apparatus and when detonation occurs. The exact amount of time which will elapse between application of electrical voltage to the apparatus of the present invention and detonation of the explosive charge within the detonator is dependent upon the speed of the motor 50, the pitch of lead screw 56, and the distance that the lead screw has to stroke. Further, the voltage applied to the apparatus of the present invention, i.e. the electrical voltage which is applied to motor 50, is several orders of magnitude greater than that required to electrically activate a conventional detonator. Thus, the possibility of high radio frequencies and/or stray voltages actuating the firing pin is essentially eliminated by use of the present invention.

Figure 2:
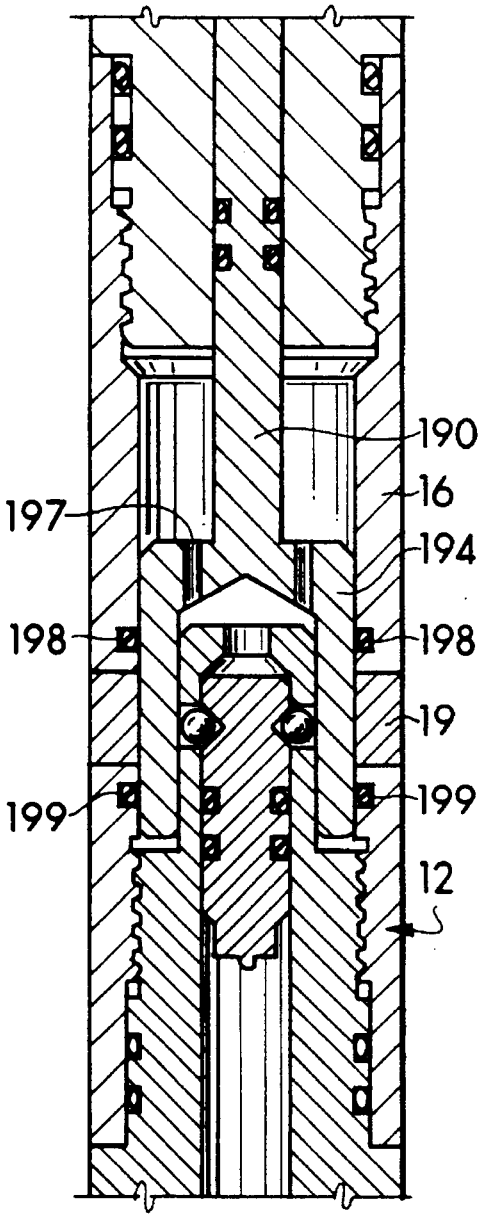
FIG. 2 is a cutaway, cross sectional view of an alternative embodiment of the retainer sleeve portion of the retainer rod of the detonating apparatus of the present invention.

An alternative embodiment of retainer rod is illustrated in FIG. 2 as 190 and includes a retainer sleeve portion 194 configured and sized to cover port(s) 17 in second portion 16 of housing 12. O-rings 198 and 199 are provided about the periphery of sleeve portion 194 and are positioned on opposite sides of port(s) 17 to prevent communication of well fluid pressure to the interior of second housing portion 16 and sleeve 194. In this manner, fluid pressure does not act upon rod 190 and motor 50 or firing pin 100 until sleeve 194 is moved to a position where port(s) 17 are uncovered and firing pin 100 is released for movement. In this embodiment, port(s) 197 are provided in the top of sleeve 194 to relieve fluid pressure transmitted to motor 50 via rod 190, connector 70, bushing 60 and lead screw 56.

Figure 3:
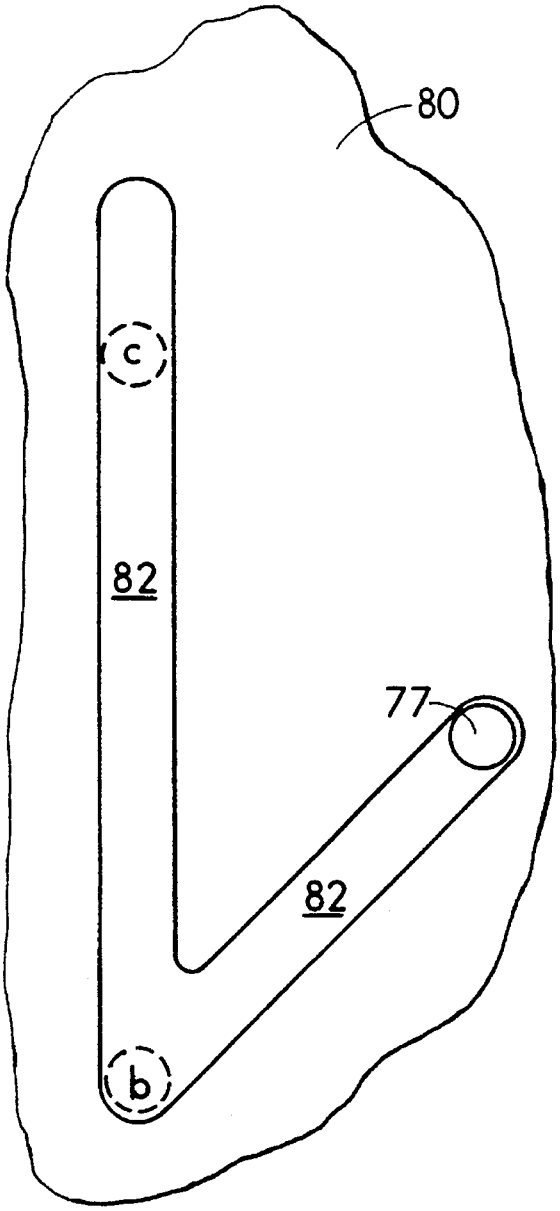
FIG. 3 is a laid out arrangement of an automatic I-slot for use in conjunction with the apparatus of the present invention.

Several other fail safe devices may be included in the apparatus of the present invention to further ensure the safety thereof. For example, a thermal switch 132 (FIG. 1 a) may be used in conjunction with motor 50 so that current can only be applied thereto when the switch is exposed to temperatures, such as those encountered in a subterranean well, for a period of time sufficient to close the switch. A discrete logic circuit relay switch 134 may also be used in conjunction with motor 50 which requires a digital or analog signal to actuate the circuit thereby permitting current flow to motor 50. Firing pin 100 can be further secured to male portion 44 of connecting sub 40 by means of shear pins 96 (FIG. 1*c*) to guard against premature firing should the locking mechanism described above fail. As illustrated in FIG. 3, slot 82 in guide sleeve 80 may also be configured in the form of a J-slot to provide a further locking mechanism. From the initial position illustrated in FIG. 3, movement of the bushing upon application of a particular current to motor 50 would move pin 77 to position b within slot 82 while application of reversed polarity current to motor 50 would be required to move the bushing as previously described above to position pin at c in FIG. 3 so as to unlock the firing pin. It will be evident to a skilled artisan that the length of retainer sleeve portion 94 or 194 needs to be shortened to permit downward movement of bushing 60, guide coupling 70, and retainer rod 90 during movement of pin 77 to position b. As will be apparent to the skilled artisan, other slot configurations than the J-slot configuration illustrated in FIG. 3 can be utilized to perform an equivalent locking function.

Although male portion 44 is illustrated as having ports 45 into which balls 46 are positioned to secure firing pin 100, other alternative locking mechanisms can be employed to releasably secure firing pin 100 within male portion 44. For example, male portion 44 can be formed as an inwardly extending collet latch which sleeve 94 or 194 biases into engagement with the groove in the exterior surface of firing pin 100. When sleeve 94 or 194 is lifted from male portion 44, the collet retracts outwardly permitting movement of the firing pin. In this embodiment, balls 46 are eliminated.

Figure 4A:
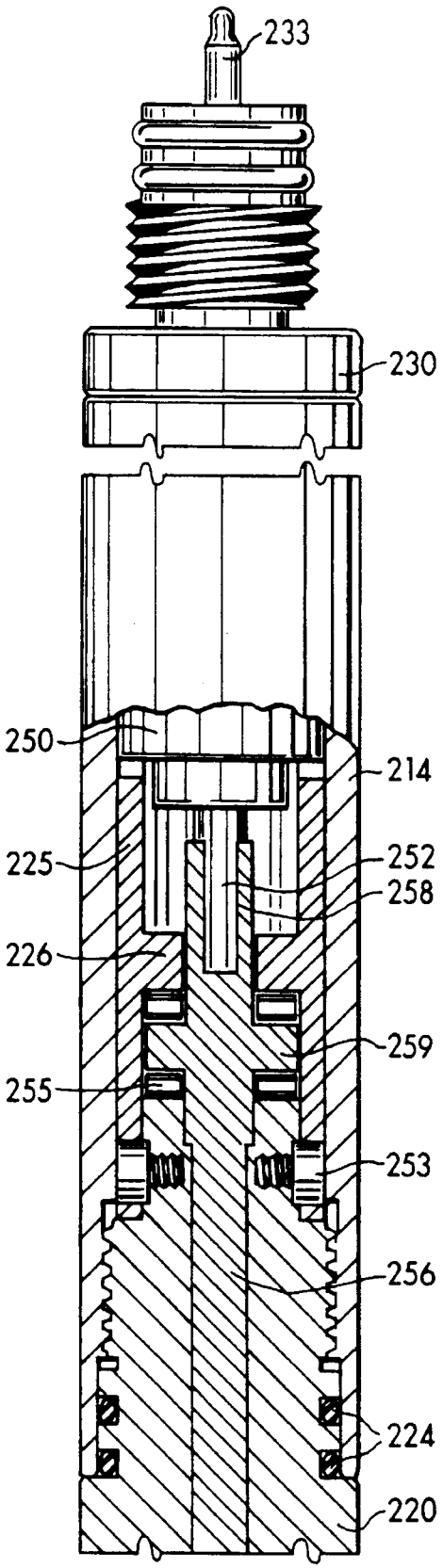
FIGS. 4*a*, 4*b* and 4*c* are a partially cutaway, cross sectional view of another embodiment of the detonating apparatus of the present invention.
Figure 4B:
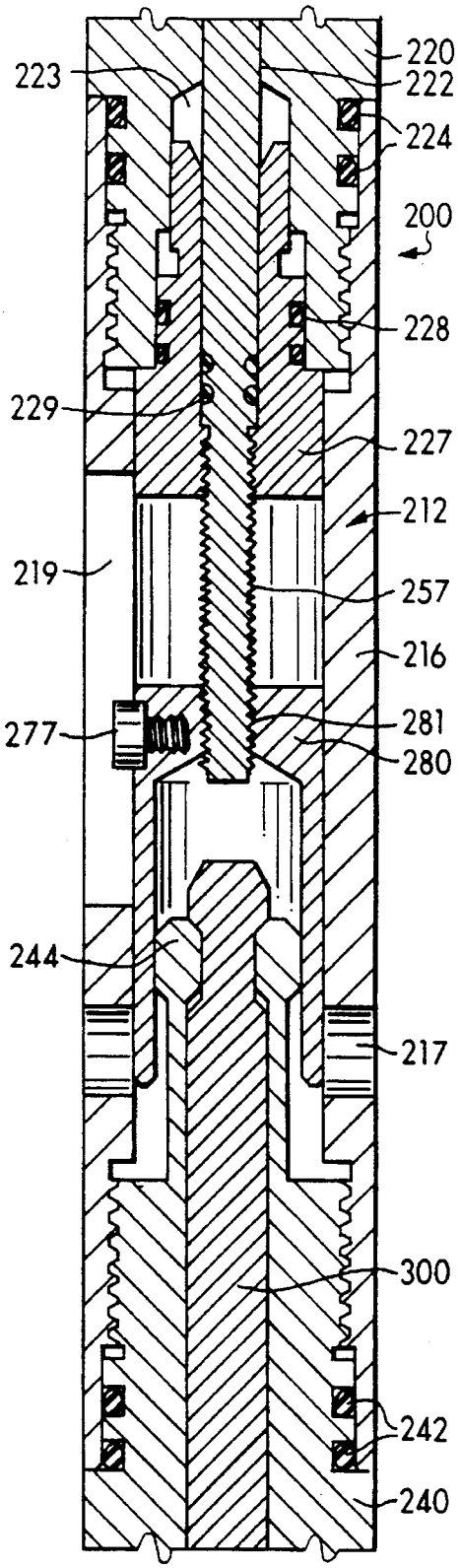
Figure 4C:
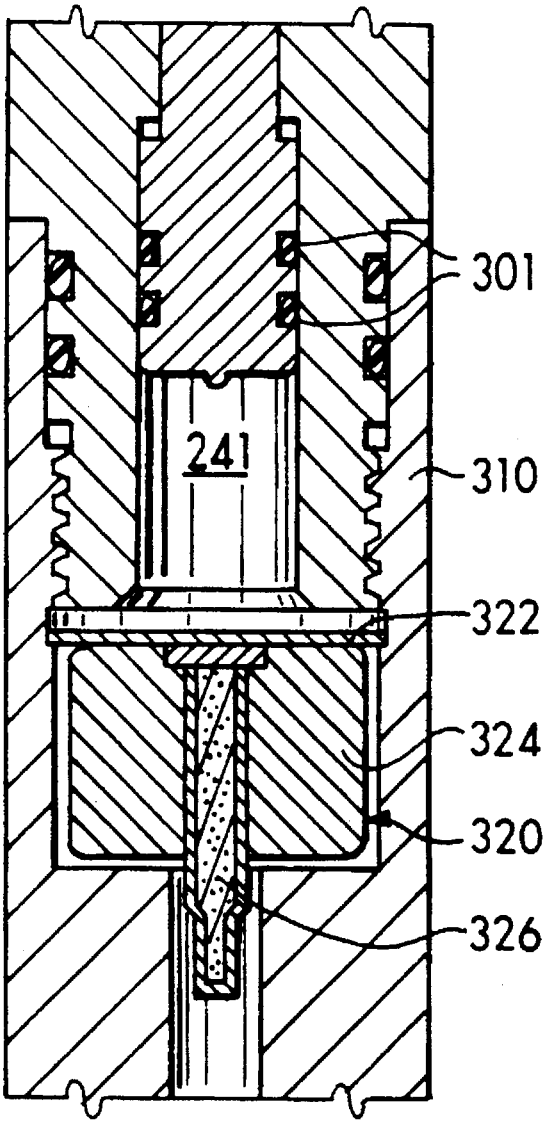

Referring now to FIGS. 4*a–c*, another embodiment of the apparatus of the present invention is illustrated generally as 200 and comprises a generally tubular housing 212 having a first section 214 and a second section 216 which are releasably secured together by means of threaded engagement with connection sub 220. Connection sub 220 has a bore 222 therethrough which terminates at one end of sub 220 in an enlarged section 223. A gland nut 227 is threadably secured to and partially positioned within enlarged section 223 of bore 222. Second section 216 is provided with at least one port 217 therethrough. A plurality of O-rings 224 are positioned between the connection sub 220 and first and second housing sections 214 and 216, respectively, to provide a fluid tight seal therebetween. One end of housing 212 is releasably secured to an electrical connection sub 230 by threaded engagement while the other end of housing 212 is releasably secured to a detonator connection sub 240 by threaded engagement therewith. O-rings (not illustrated) are positioned between first housing section 214 and electrical connection sub 230 and O-rings 242 are positioned between second housing section 216 and detonator connection sub 240 to provide a tight seal therebetween.

Electrical connection sub 230 is substantially similar to electrical connection sub 30 which is illustrated in FIG. 1*a* and described above. Electrical connection sub 230 is electrically connected to a D.C. electrical motor 250 by means of wire 38 which is secured to contact button 37 as illustrated in FIG. 1*a*. Motor 250 has a shaft 252 extending from one end thereof which terminates in a generally rectangular or blade configuration. The lower end of motor 250 mates with a motor mount 225 which is positioned within first section 214 of housing 212. Motor mount 225 is provided with an inwardly extending, generally annular portion 226. The upper end of drive rod 256 is provided with a slot 258 which is configured to receive and mate with the blade configured end of motor shaft 252. Drive rod 256 is also provided with a generally annular collar 259. A plurality of roller thrust bearings 255 are situated on both sides of collar 259 and are secured between drive rod 256, motor mount 226 and connection sub 220 by means of cap screw(s) 253. Drive rod 256 has a threaded portion 257.

A retainer sleeve 280 is positioned within second section 216 of tubular housing 212 and is provided with a threaded bore 281 through the upper end thereof within which threaded portion 257 of drive rod 256 is engaged. A cap screw or guide pin 277 is threadably engaged to and extends from the outer surface of retainer sleeve 280 so as to be received within slot 219 formed in second section 216. As assembled upon threaded portion 257 of drive rod 256, retainer sleeve 280 can be moved in either direction along threaded portion 257 depending upon the rotation applied to drive rod 256 by motor 250. A shear pin (not illustrated in FIG. 4) may be provided in retainer sleeve 280 and extend into second section 216 to inhibit movement of sleeve 280 along threaded portion 257 of drive rod 256 until a predetermined amount of torque is applied by motor 250. Such shear pin affords the operator of the apparatus a small period of time after application of voltage to motor 250 within which voltage may be terminated prior to movement of any apparatus components which would cause detonation. Drive rod 256 extends through bore 222 in connection sub 220 and has gland nut 227 positioned therearound. O-rings 229 are provided around rod 256 to provided a fluid tight seal between rod 256 and gland nut 227. O-rings 228 are provided around gland nut 227 to provides a fluid tight seal between connection sub 220 and gland nut 227.

As positioned within second section 216 of tubular housing 212, retainer sleeve 280 receives an elongated male portion 244 of detonator connection sub 240. Male portion 244 is formed as an inwardly extending collet latch. A firing pin 300 has a groove formed within the outer surface thereof and is positioned within bore 241 through sub 240. Firing pin 300 is releasably secured within male portion 244 by means of the collet latch configuration of male portion 244 being biased into engagement with firing pin 300 by retainer sleeve 280. O-rings 301 are positioned around firing pin 300 to provide for a fluid tight seal with detonator connecting sub 240 as thus assembled.

One end of detonator connecting sub 240 is releasably secured to a detonator sub 310 by threaded engagement. A detonator which is illustrated in FIG. 4*c* generally as 320 comprises a relatively thin disk 322 constructed of a suitable material, such as copper, a housing 324, and an explosive charge 326. The other end of detonator sub 310 can be provided with a suitable male, female or other coupling to secure the assembly of the present invention to a desired tool, for example perforating gun(s), jet cutter(s), or chemical cutter(s).

As assembled, the contact pin 233 of the firing assembly of the present invention is secured to a casing collar locator which in turn is suspended from the wellhead at the surface by wireline (not illustrated) as will be evident to a skilled artisan. The assembly is lowered into the subterranean well until the tool which is secured thereto is positioned at a desired depth. Once positioned within a well, fluid within the well will be communicated into the interior of second portion 216 of housing 212 via port(s) 217. O-rings 224, 228, 229 and 242 cooperate to maintain well fluid within this area of the apparatus. Initially firing pin 300 is secured within male portion 244 of connecting sub 240 by means of the collet latch configuration of male portion 244 being biased into engagement with the groove in firing pin 300 by retainer sleeve 280. Once a desired subsurface location is reached, electrical current is applied to motor 250 from an electrical source at the surface, such as a power supply, via the wireline, casing collar locator, and electrical connection sub 230. Motor 250 rotates shaft 252 and drive rod 256 causing retainer sleeve 280 to move axially downwardly until pin 277 which extends from the outer surface of retainer sleeve 280 moves to position b (FIG. 3) within slot 219 of second section 216. Thereafter, application of reverse polarity to motor 250 causes sleeve 280 to move axially upwardly upon threaded section 257 of drive rod 256. Once retainer sleeve 280 moves past male portion 244, the collet latch configuration of male portion 244 is permitted to expand and disengage from firing pin 300. The pressure of well fluid which is communicated via port(s) 217 on firing pin 300 assists the downward movement of firing pin 300 through subs 240 and 310 and into contact with detonator 320 thereby striking plate 322 and detonating explosive charge 326. Detonation of charge 326 in turn detonates an explosive detonating cord (not illustrated) which activates the tool secured to the assembly.

While the foregoing preferred embodiments of the invention have been described and shown, it is understood that the alternatives and modifications, such as those suggested and others, may be made thereto and fall within the scope of the invention.

We claim:

1. An apparatus for activating electric wireline firing systems comprising:

a tubular housing;

a motor having a lead screw secured thereto and positioned within said housing;

a bushing positioned upon said lead screw and capable of axial movement upon said lead screw when said lead screw is rotated;

a retainer sleeve positioned within said housing and connected to said bushing; and a firing pin positioned within said housing and secured against movement by said retainer sleeve.

2. The apparatus of claim 1 further comprising:

a detonator.

3. The apparatus of claim 1 further comprising:

a thermal switch electrically connected to said motor.

4. The apparatus of claim 1 further comprising:

a discrete logic circuit relay switch electrically connected to said motor.

5. The apparatus of claim 1 wherein said firing pin is releasably secured to said retainer sleeve by at least one shear pin.

6. The apparatus of claim 1 wherein said housing has at least one aperture therethrough.

7. The apparatus of claim 6 wherein said at least one aperture is covered by a material which may be removed therefrom by application of temperature, pressure, or fluid.

8. The apparatus of claim 1 further comprising:

an elongated rod positioned within said housing and secured to said retainer sleeve; and a coupling connecting said bushing to said elongated rod.

9. The apparatus of claim 8 further comprising:

a sleeve positioned within said housing and surrounding said coupling, said sleeve having a slot therein; and a pin secured to said coupling and extending into said sleeve so as to inhibit rotation of said bushing upon said lead screw.

10. The apparatus of claim 9 wherein said slot is configured as a J-slot to inhibit movement of said firing pin until said pin is manipulated through said J-slot by application of voltages of varying polarity to said motor.

11. The apparatus of claim 9 further comprising:

a shear pin secured to said coupling and extending into said slot to inhibit movement of said bushing upon said lead screw until sufficient torque is applied by said motor via said lead screw, said bushing, and said coupling to shear said shear pin.

12. The apparatus of claim 6 further comprising:

a sub secured to and partially positioned within said housing, said firing pin being secured within said sub.

13. The apparatus of claim 12 wherein said sub has at least one aperture therethrough into which at least one ball is positioned, said sleeve surrounding a portion of said sub so as to force said at least one ball into contact with a groove on the exterior of said firing pin thereby securing said firing pin against movement.

14. The apparatus of claim 13 wherein said retainer sleeve has at least one aperture therethrough.

15. The apparatus of claim 14 wherein said retainer sleeve sealingly covers said at least one aperture through said housing.

16. The apparatus of claim 12 wherein said sub is further secured to said firing pin by means of at least one shear pin.

17. The apparatus of claim 12 wherein said sub has an inwardly extending collet, said sleeve surrounding at least a portion of said sub so as to force said collet into contact with a groove on the exterior of said firing pin thereby securing said firing pin against movement.

18. The apparatus of claim 1 further comprising;

means for inhibiting movement of said bushing upon said lead screw until voltages of varying polarity are applied to said motor.

19. An apparatus for activating electric wireline firing systems comprising:

means for securing a firing pin against movement toward a detonator;

means for releasing said firing pin from said securing means in response to voltage being applied to said releasing means; and means for applying fluid pressure to said firing pin.

20. An apparatus for activating electric wireline firing systems comprising:

means for securing a firing pin against movement toward a detonator;

means for releasing said firing pin from said securing means in response to voltage being applied to said releasing means; and means for applying fluid pressure to said firing pin when said firing pin is released from said securing means.

21. A method of activating an electric wireline firing system having a firing pin and a detonator, said method comprising:

releasably securing a firing pin against movement toward a detonator by a securing means which is connected to a motor;

locking said securing means against movement;

applying a first voltage to said motor to unlock said securing means; and thereafter applying a second voltage to said motor which is sufficient to move said securing means and permit said firing pin to move and strike said detonator.

22. An apparatus for activating electric wireline firing systems comprising:

a housing;

an electromechanical device positioned within said housing;

a rod connected to said electromechanical device and positioned within said housing;

a retainer sleeve positioned within said housing and connected to said rod, said retainer sleeve capable of axial movement; and a firing pin positioned within said housing and releasably secured against movement by said retainer sleeve.

23. The apparatus of claim 22 wherein said electromechanical device is a motor, said rod has a threaded portion, and said retainer sleeve is capable of axial movement upon said threaded portion when said rod is rotated by said motor.

24. The apparatus of claim 22 further comprising:

a detonator.

25. The apparatus of claim 22 further comprising:

a thermal switch electrically connected to said electromechanical device.

26. The apparatus of claim 22 further comprising:

a discrete circuit relay switch electrically connected to said electromechanical device.

27. The apparatus of claim 22 wherein said housing has at least one aperture therethrough.

28. The apparatus of claim 23 further comprising:

a pin secured to said sleeve and received within a slot in said housing, said slot being configured to inhibit movement of said firing pin until said pin is manipulated through said slot by application of voltages of varying polarity to said motor.

29. The apparatus of claim 28 further comprising:

a shear pin secured to said sleeve and extending into said housing to inhibit movement of said sleeve upon said rod until sufficient torque is applied by said motor via said rod and said sleeve to shear said shear pin.

30. The apparatus of claim 22 further comprising:

a sub secured to and partially positioned within said housing, said firing pin being secured within said sub.

31. The apparatus of claim 30 wherein said sub has an inwardly extending collet, said sleeve surrounding at least a portion of said sub so as to force said collet into contact with a groove on the exterior of said firing pin thereby securing said firing pin against movement.

32. The apparatus of claim 30 wherein said sub is further secured to said firing pin by means of at least one shear pin.

* * * * *